US009568249B2

(12) United States Patent
Thawani et al.

(10) Patent No.: US 9,568,249 B2
(45) Date of Patent: Feb. 14, 2017

(54) HEAT EXCHANGER

(75) Inventors: Prakash Tuljaram Thawani, Bloomfield Hills, MI (US); Stephen Sinadinos, Commerce Township, MI (US); Justin P. Black, Novi, MI (US)

(73) Assignee: Denso International America, Inc., Southfield, MI (US)

( * ) Notice: Subject to any disclaimer, the term of this patent is extended or adjusted under 35 U.S.C. 154(b) by 600 days.

(21) Appl. No.: 13/596,170

(22) Filed: Aug. 28, 2012

(65) Prior Publication Data

US 2014/0060785 A1 Mar. 6, 2014

(51) Int. Cl.
*F28F 7/00* (2006.01)
*F28D 7/10* (2006.01)

(52) U.S. Cl.
CPC ..... *F28D 7/106* (2013.01)

(58) Field of Classification Search
CPC ..... F28F 21/00; F28F 21/062; F28F 2255/02; F28D 7/106; F28D 7/0008; F28D 7/10; F28D 7/12
USPC ..... 256/123.15, 123.16, 123.3, 124.4, 256,256/96, 123.21; 165/154, 178, 180; 285/123.15, 285/123.16, 123.3, 124.4, 256, 96, 123.21
See application file for complete search history.

(56) References Cited

U.S. PATENT DOCUMENTS

| | | | | |
|---|---|---|---|---|
| 69,576 | A | 10/1867 | Nicholson | |
| 1,977,809 | A * | 10/1934 | Sutter | B60H 1/18 165/154 |
| 2,985,435 | A * | 5/1961 | Gross | F28D 7/026 165/156 |
| 3,105,708 | A * | 10/1963 | Esty | 285/41 |
| 3,529,664 | A * | 9/1970 | Baker et al. | 165/178 |
| 3,802,491 | A * | 4/1974 | Plank et al. | 165/51 |
| 4,960,167 | A | 10/1990 | Stenlund | |
| 5,762,858 | A | 6/1998 | Maeda et al. | |
| 6,098,704 | A * | 8/2000 | Tsuchiya | B21C 23/10 165/154 |
| 6,129,394 | A * | 10/2000 | Bathla | 285/382 |
| 6,305,407 | B1 * | 10/2001 | Selby | F16L 35/00 137/312 |
| 7,726,386 | B2 * | 6/2010 | Specht | 165/134.1 |
| 7,775,560 | B2 * | 8/2010 | Zanardi et al. | 285/280 |
| 2006/0096744 | A1 * | 5/2006 | Nakamura et al. | 165/154 |
| 2010/0244469 | A1 * | 9/2010 | Gerwolls et al. | 293/120 |
| 2011/0168369 | A1 * | 7/2011 | Kim et al. | 165/154 |
| 2011/0198063 | A1 * | 8/2011 | Meyer | 165/119 |

FOREIGN PATENT DOCUMENTS

| | | | | |
|---|---|---|---|---|
| DE | 102011119313 | A1 * | 5/2013 | F25B 40/00 |

OTHER PUBLICATIONS

DE 102011119313 A1 machine translation.*

* cited by examiner

*Primary Examiner* — Len Tran
*Assistant Examiner* — Gordon Jones
(74) *Attorney, Agent, or Firm* — Harness, Dickey & Pierce, P.L.C.

(57) ABSTRACT

A double pipe internal heat exchanger including a pipe, a first ferrule, a second ferrule, and a flexible hose. The pipe defines an inner channel. The first ferrule and a second ferrule are mounted to the pipe and spaced apart along the pipe. The flexible hose is mounted to the first ferrule and the second ferrule. The flexible hose defines an outer channel between the pipe and the flexible hose.

16 Claims, 2 Drawing Sheets

HEAT EXCHANGER

FIELD

The present disclosure relates to a double pipe internal heat exchanger for use with, for example, motor vehicle air conditioning systems.

BACKGROUND

This section provides background information related to the present disclosure, which is not necessarily prior art.

Air conditioning systems, such as those of a motor vehicle, can include a double pipe internal heat exchanger (IHX) to transfer high pressure liquid refrigerant from a condenser to an evaporator, and transfer low pressure gas refrigerant from the evaporator to a compressor. Such double pipe IHX designs often include a rigid inner pipe, and a rigid outer pipe that surrounds and is welded to the inner pipe. The rigid outer pipe is often made of a metallic, such as aluminum for example. One pipe carries the low pressure gas, such as the inner pipe for example, and the other pipe carries the high pressure liquid, such as the outer pipe for example. The liquid and gas pass through the double pipe IHX in opposite directions to permit heat exchange therebetween. As the liquid passes through the outer pipe past the gas, the relatively high temperature liquid is cooled by the relatively low temperature gas.

Because the outer pipe is made of a rigid material, it may vibrate as the high pressure liquid passes therethrough, which can result in undesirable noises being heard in the vehicle passenger cabin. It would thus be desirable to provide a double pipe internal heat exchanger that dampens vibrations and reduces noises that may result from passage of liquid and gas therethrough.

SUMMARY

This section provides a general summary of the disclosure, and is not a comprehensive disclosure of its full scope or all of its features.

The present teachings provide for a double pipe internal heat exchanger that includes a pipe, a first ferrule, a second ferrule, and a flexible hose. The pipe defines an inner channel. The first ferrule and a second ferrule are mounted to the pipe and spaced apart along the pipe. The flexible hose is mounted to the first ferrule and the second ferrule. The flexible hose defines an outer channel between the pipe and the flexible hose.

The present teachings also provide for a double pipe internal heat exchanger including a rigid pipe, a first ferrule, a second ferrule, and a flexible hose. The rigid pipe defines an inner channel. The first ferrule and the second ferrule are both mounted to the rigid pipe and spaced apart along the rigid pipe. Each of the first ferrule and the second ferrule include a first flange connected to the outer surface of the rigid pipe, a clamp, and a conduit. The flexible hose is coupled to the first ferrule with the clamp of the first ferrule and coupled to the second ferrule with the clamp of the second ferrule. The flexible hose defines an outer channel between the rigid pipe and the flexible hose. The conduit of each of the first ferrule and the second ferrule is in fluid communication with the outer channel.

The present teachings further provide for a double pipe internal heat exchanger including a rigid pipe, a first ferrule, a second ferrule, and a flexible hose. The rigid pipe defines an inner channel. The first ferrule is mounted to the rigid pipe at a first end of the rigid pipe. The first ferrule includes a first conduit. The second ferrule is mounted to the rigid pipe at a second end of the rigid pipe. The second ferrule includes a second conduit. A flexible hose is coupled to both the first ferrule and the second ferrule. The flexible hose extends between the first ferrule and the second ferrule and surrounds the rigid pipe to define an outer channel between the flexible hose and the rigid pipe. Each of the first conduit and the second conduit are in fluid communication with the outer channel. Each of the first ferrule and the second ferrule include a clamp that is crimped onto the flexible hose to secure the flexible hose to each of the first ferrule and the second ferrule.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 2 is illustrated as though the ferrules and outer hose of FIG. 1 were not in cross section in FIG. 1;

FIG. 4 is illustrated as though the ferrules and outer hose of FIG. 3 were not in cross section in FIG. 3.

Corresponding reference numerals indicate corresponding parts throughout the several views of the drawings.

DETAILED DESCRIPTION

Example embodiments will now be described more fully with reference to the accompanying drawings.

Figures 1, 3:
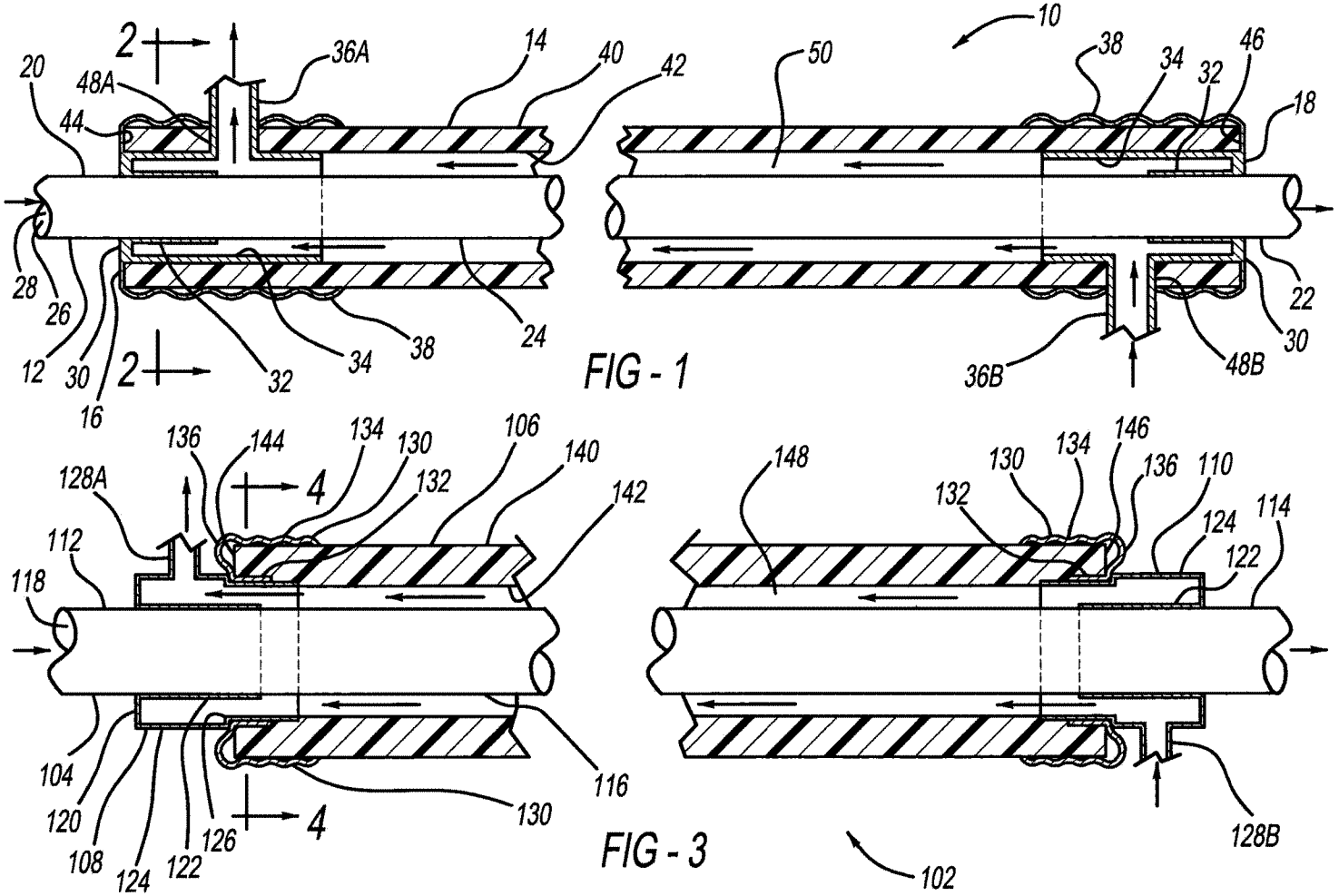
FIG. 1 is a side view of a double pipe internal heat exchanger assembly according to the present teachings, ferrules and an outer hose of the assembly are illustrated in cross-section.
FIG. 3 is a side view of another double pipe internal heat exchanger assembly according to the present teachings, ferrules and an outer hose of the assembly are illustrated in cross-section.
Figure 2:
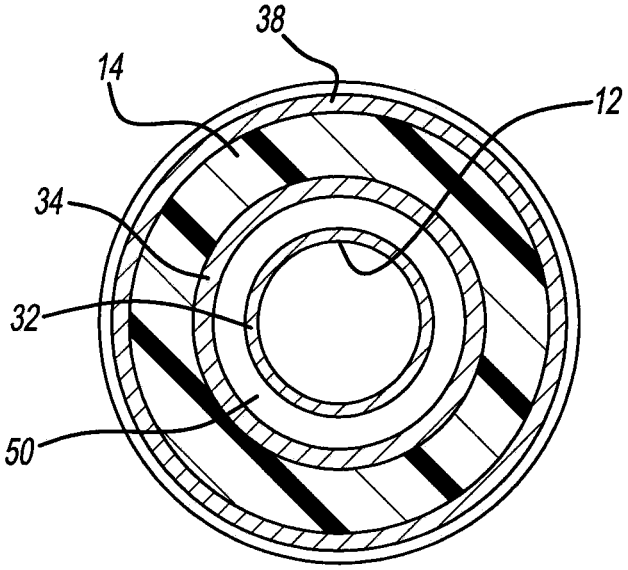
FIG. 2 is a cross-sectional view of FIG. 1 taken along line 2-2 of FIG. 1.

With initial reference to FIGS. 1 and 2, a double pipe internal heat exchanger according to the present teachings is illustrated at reference numeral 10. The double pipe internal heat exchanger 10 generally includes a pipe 12, a hose 14, a first ferrule 16, and a second ferrule 18. The pipe 12 includes a first pipe end 20, a second pipe end 22 that is opposite to the first pipe end 20, an outer pipe surface 24, and an inner channel 26 defined by an inner pipe surface 28 that is opposite to the outer pipe surface 24. The pipe 12 is generally rigid and can be made of any material suitable for permitting passage of, for example, either a gaseous refrigerant or a liquid refrigerant therethrough. The pipe 12 can be made of steel or aluminum, for example.

The first ferrule 16 generally includes a base 30, a first flange 32, a second flange 34, an outlet conduit 36A, and a clamp 38. The first flange 32 extends from the base 30, which is generally planar. As illustrated in FIG. 2, the first flange 32 is generally cylindrical and positioned such that the pipe 12 extends therethrough. The first flange 32 is sealingly connected and secured to the outer pipe surface 24 in any suitable manner, such as with an interference fit or by welding in order to secure the first ferrule 16 proximate to the first pipe end 20.

The second flange 34 extends from the base 30 generally parallel to the first flange 32, and is spaced apart from the first flange 32. As illustrated, the second flange 34 extends further from the base 30 than the first flange 32. However, the second flange 34 can extend from the base 30 to any distance suitable to support the hose 14 about the pipe 12, as further described herein. Like the first flange 32, the second flange 34 is cylindrical, as illustrated in FIG. 2. The outlet conduit 36A extends from, and generally perpendicular to, the second flange 34. The outlet conduit 36A defines a passage through the second flange 34.

The clamp 38 also extends from the base 30. The clamp 38 extends generally parallel to both the first flange 32 and the second flange 34. The clamp 38 is at an outermost portion of the first ferrule 16 such that the second flange 34 is between the clamp 38 and the first flange 32, and the clamp 38 abuts the hose 14 to sealingly secure the hose 14 between the clamp 38 and the first flange 32. The clamp 38 is illustrated as extending further from the base 30 than the second flange 34, however, the clamp 38 can extend from the base 30 to any suitable distance to secure the hose 14 to the first ferrule 16. The clamp 38 extends from the base 30 in generally a wave-like manner with a series of peaks and troughs, which can be formed by, for example, a crimping device used to crimp the clamp 38 onto the hose 14.

The second ferrule 18 is substantially similar to the first ferrule 16. Therefore, the description of the first ferrule 16 also applies to the second ferrule 18, and features common to both the first ferrule 16 and the second ferrule 18 are referred to in the drawings using the same reference numbers. The only substantial difference between the first ferrule 16 and the second ferrule 18 is the orientation in which they are mounted to the pipe 12. For example and with reference to FIG. 1, second ferrule 18 is mounted about 180° relative to the first ferrule 16 such that the outlet conduit 36A of the first ferrule 16 and the conduit 36B of the second ferrule 18 are orientated in opposite directions. The conduit 36B is substantially similar to the outlet conduit 36A, and will be referred to herein as an inlet conduit 36B because liquid or gas refrigerant can be introduced into the double pipe internal heat exchanger 10 through the inlet conduit 36B.

The hose 14 includes an outer hose surface 40, an inner hose surface 42 that is opposite to the outer hose surface 40, a first hose end 44, and a second hose end 46 that is opposite to the first hose end 44. The hose 14 defines an opening 48A to accommodate the outlet conduit 36A, and an opening 48B to accommodate the inlet conduit 36B. The hose 14 is generally cylindrical and can be made of any suitable flexible material sufficient to dampen vibrations caused by the flow of liquid or gas therethrough, and to prevent the liquid or gas from leaking out from within the hose 14. For example, the hose 14 can be made of a suitable polymer, rubber, or nylon. The hose 14 can also include a suitable liquid or gas impermeable barrier layer therein to prevent leakage of liquid or gas refrigerant out from within the double pipe internal heat exchanger 10.

The hose 14 is arranged such that the first hose end 44 abuts the base 30 of the first ferrule 16, and the second hose end 46 abuts the base 30 of the second ferrule 18. The hose 14 is seated on and supported by the second flange 34 of each of the first ferrule 16 and the second ferrule 18, and is positioned such that the outlet conduit 36A extends through the opening 48A and the inlet conduit 36B extends through the opening 48B. The clamp 38 of each of the first ferrule 16 and the second ferrule 18 is crimped onto the outer hose surface 40 using any suitable crimping device in order to secure the hose 14 between the clamp 38 and the second flange 34 at both the first ferrule 16 and the second ferrule 18. In this manner, the hose 14 is secured to each of the first and second ferrules 16 and 18.

The second flange 34 of each of the first ferrule 16 and the second ferrule 18 supports the hose 14 spaced apart from the outer pipe surface 24 in order to define an outer channel 50 between the outer pipe surface 24 and the inner hose surface 42. Each of the outlet conduit 36A and the inlet conduit 36B are in fluid communication with the outer channel 50. Therefore, gas or liquid refrigerant passed through the inlet conduit 36B will pass into the outer chamber 50, across the outer pipe surface 24, and out from within the outer channel 50 through the outlet conduit 36A. Because the hose 14 is flexible, it will dampen any vibrations that may be caused by the flow of liquid or gas through the outer channel 50.

The material of the hose 14 can vary depending on whether liquid or gas refrigerant is passed through the outer channel 50. For example, if liquid refrigerant is passed through the outer channel 50 then the hose 14 may include a suitable barrier layer therein in order to minimize or prevent permeation of the liquid refrigerant through the hose 14. The hose 14 can also be made of a material sufficient to withstand the pressure at which the liquid refrigerant is passed through the outer channel 50, such as about 500 to about 600 PSI. Alternatively, if gas refrigerant is passed through the outer channel 50, the hose 14 may not include a barrier layer and may be made of a suitable material strong enough to withstand about 200 PSI, which is the pressure at which the gas refrigerant may be passed through the outer channel 50. If gas refrigerant is passed through the outer channel 50, the hose 14 need not include a barrier layer.

Because the liquid refrigerant is at a higher temperature than the gas refrigerant, as the liquid and gas flow through the double pipe internal heat exchanger 10 in opposite directions, temperature of the liquid and gas move towards equilibrium, thereby cooling the higher temperature liquid refrigerant. To facilitate flow across the outer channel 50 from the inlet conduit 36B to the outlet conduit 36A, the inner hose surface 42 may define a plurality of channels recessed in the inner hose surface 42 extending between the first and second hose ends 44 and 46. The channels can extend linearly between the first and the second hose ends 44 and 46, or in a spiral-like manner. The channels facilitate heat exchange between the liquid refrigerant and the gas refrigerant, and reduce both vibrations and noise, which may occur as the liquid and gas refrigerants pass through the double pipe internal heat exchanger 10. The channels also facilitate flow of the liquid or gas refrigerant through the outer channel 50, particularly in instances where bending the double pipe internal heat exchanger 10 causes the inner hose surface 42 to contact the outer pipe surface 24. In such instances, because the channels are recessed within the inner hose surface 42, liquid or gas will still be able to pass through the outer channel 50 even at areas where the inner hose surface 42 contacts the outer pipe surface 24. The channels are described in the following United States issued patents, which are incorporated herein by reference: U.S. Pat. No. 5,909,766 issued Jun. 8, 1999 and assigned to DENSO Corporation of Kariya, Japan; U.S. Pat. No. 6,098,704 issued Aug. 8, 2000 and assigned to DENSO Corporation of Kariya, Japan; and U.S. Pat. No. 7,866,378 issued Jan. 11, 2011 and assigned to both DENSO Corporation of Kariya, Japan, and DENSO Airs Corporation of Anjo, Japan.

Figure 4:
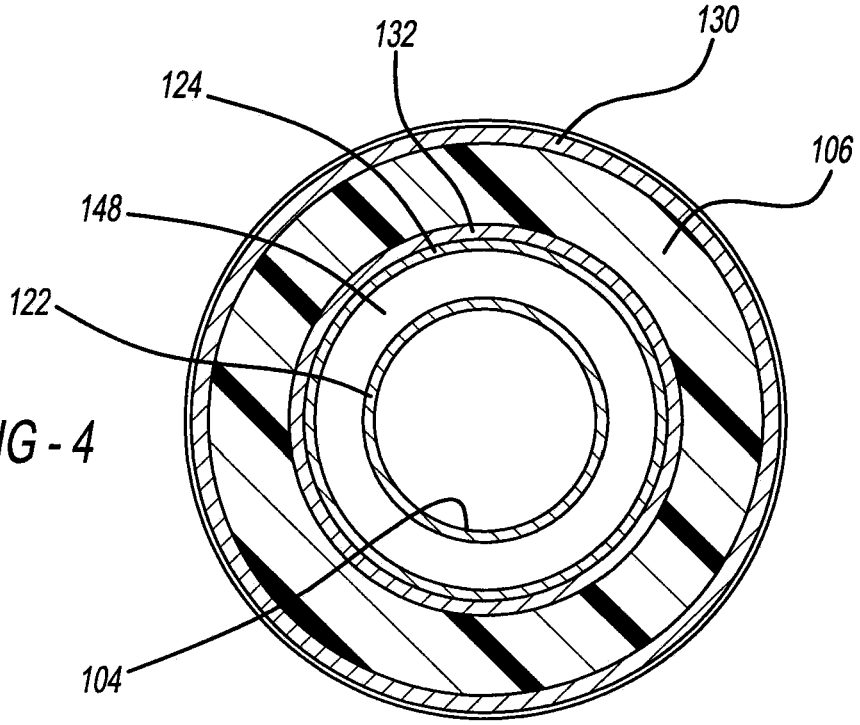
FIG. 4 is a cross-sectional view of FIG. 3 taken along line 4-4 of FIG. 3.

Another double pipe internal heat exchanger according to the present teachings is illustrated in FIGS. 3 and 4 at reference number 102. The double pipe internal heat exchanger 102 generally includes a pipe 104, a hose 106, a first ferrule 108, and a second ferrule 110. The pipe 104 is substantially similar to the pipe 12 and includes a first pipe end 112, a second pipe end 114 that is opposite to the first pipe end 112, and an outer pipe surface 116. The pipe 104 defines an inner channel 118 extending therethrough. The pipe 104 is generally rigid and is substantially similar to the pipe 12 of the double pipe internal heat exchanger 10. The pipe 104 can be made of any suitable material, such as steel or aluminum.

The first ferrule 108 is substantially similar to the second ferrule 110, and thus the following description of the first ferrule 108 also applies to the second ferrule 110. Features in common between the first ferrule 108 and the second ferrule 110 are identified in the drawings with the same reference numbers. The first ferrule 108 generally includes a base 120, a first flange 122, and a second flange 124. The first flange 122 extends from the base 120 generally perpendicular to the base 120, and is generally cylindrical, as illustrated in FIG. 4. The first flange 122 is arranged such that the pipe 104 extends through the first flange 122. The first flange 122 is sealingly mounted to the pipe 104 at the outer pipe surface 116 in any suitable manner, such as with an interference fit or by welding. The second flange 124 also extends from the base 120 and is spaced apart from the first flange 122. The second flange 124 extends generally parallel to the first flange 122, except at step portion 126, which is generally at a midpoint along a length of the second flange 124. The second flange 124 is generally cylindrical, as illustrated in FIG. 4. At the step portion 126, the second flange 124 steps inward towards the first flange 122 to provide the first ferrule 108 with a decreased diameter on a side of the step portion 126 opposite to the base 120. The first ferrule 108 includes an outlet conduit 128A at the second flange 124 through which liquid or gas refrigerant can pass out from within the first ferrule 108.

A clamp 130 is mounted to the second flange 124 at an outer surface thereof, on the side of the step portion 126 that is opposite to the base 120. The clamp 130 generally includes a base portion 132, a coupling portion 134, and an intermediate portion 136. The intermediate portion 136 is between the base portion 132 and the coupling portion 134. The base portion 132 is sealingly mounted to the second flange 124 in any suitable manner, such as with an interference fit or by welding. The coupling portion 134 is generally wave-shaped and includes a series of peaks and troughs formed by, for example, a crimping device.

The hose 106 includes an outer hose surface 140 and an inner hose surface 142 that is opposite to the outer hose surface 140. The hose 106 further includes a first hose end 144 and a second hose end 146 that is opposite to the first hose end 144. The hose 106 is generally cylindrical and is wrapped around the pipe 104. The hose 106 is supported by the second flange 124 of each of the first ferrule 108 and the second ferrule 110 to support the inner hose surface 142 spaced apart from the outer pipe surface 116 to define a channel 148 therebetween. The hose 106 is substantially similar to the hose 14, and thus the description of the hose 14 is also sufficient to describe the hose 106.

The hose 106 is sealingly secured to the first ferrule 108 with the clamp 130. More specifically, the first hose end 144 is arranged between the base portion 132 and the coupling portion 134, and proximate to the intermediate portion 136 of the clamp 130. The coupling portion 134 is pressed onto the outer hose surface 140 using a suitable crimping device, for example, in order to retain the hose 106 to the first ferrule 108. The second hose end 146 is sealingly secured to the second ferrule 110 in the same manner. As illustrated in FIG. 3, the outlet conduit 128A and the inlet conduit 128B are arranged beyond the first hose end 144 and the second hose end 146 respectively, and thus the hose 106 need not include openings to accommodate either the outlet conduit 128A or the inlet conduit 128B. The double pipe internal heat exchanger 102 operates in the same manner described above with respect to the double pipe internal heat exchanger 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A double pipe internal heat exchanger comprising:

a pipe defining an inner channel;

a first ferrule and a second ferrule mounted to the pipe and spaced apart along the pipe; and a flexible hose mounted to the first ferrule and the second ferrule, the flexible hose defining an outer channel between the pipe and the flexible hose;

wherein:

a first end of the flexible hose is surrounded by a first clamp structurally integrated with the first ferrule to secure the first end to the first ferrule;

a second end of the flexible hose is surrounded by a second clamp structurally integrated with the second ferrule to secure the second end to the second ferrule; and the first ferrule includes a first conduit extending through first apertures defined in each of the flexible hose and the first clamp, the second ferrule includes a second conduit extending through second apertures defined in each of the flexible hose and the second clamp, and each of the first conduit and the second conduit are in fluid communication with the outer channel.

2. The double pipe internal heat exchanger of claim 1, wherein the flexible hose completely surrounds a portion of the pipe circumferentially and extends from the first ferrule to the second ferrule.

3. The double pipe internal heat exchanger of claim 1, wherein the first clamp is crimped onto the first end of the flexible hose, and the second clamp is crimped onto the second end of the flexible hose to secure the flexible hose to each of the first ferrule and the second ferrule;

wherein the first end of the flexible hose is encased within a first receptacle defined between the first clamp and a flange of the first ferrule; and wherein the second end of the flexible hose is encased within a second receptacle defined between the second clamp and a flange of the second ferrule.

4. The double pipe internal heat exchanger of claim 1, wherein each of the first ferrule and the second ferrule include a first cylindrical flange connected to the pipe.

5. The double pipe internal heat exchanger of claim 4, wherein the first clamp extends from a second flange of the first ferrule and the second clamp extends from a second flange of the second ferrule, the second flange of each one of the first ferrule and the second ferrule is respectively opposite to, and extends parallel to, the first flange of each one of the first ferrule and the second ferrule.

6. The double pipe internal heat exchanger of claim 5, wherein the outer channel is partially defined between the first flange and the second flange of the first ferrule, and between the first flange and the second flange of the second ferrule.

7. The double pipe internal heat exchanger of claim 6, wherein the first flange and the second flange of the first ferrule each extend from a base of the first ferrule; and wherein the first flange and the second flange of the second ferrule each extend from a base of the second ferrule.

8. The double pipe internal heat exchanger of claim 7, wherein:

the flexible hose defines the outer channel between an outer surface of the pipe and an inner surface of the flexible hose;

the pipe and the flexible hose are configured to permit passage of one of gas or liquid through the inner channel and the other of gas or liquid through the outer channel to permit exchange of heat between the gas and the liquid;

the flexible hose includes at least one of a leak resistant rubber, a leak resistant polymer, or a leak resistant nylon: and the flexible hose is configured to dampen vibrations and noise across the double pipe internal heat exchanger.

9. A double pipe internal heat exchanger comprising:

a rigid pipe defining an inner channel;

a first ferrule and a second ferrule mounted to the rigid pipe and spaced apart along the rigid pipe, each of the first ferrule and the second ferrule include a first flange connected to the outer surface of the rigid pipe, a clamp, and a conduit; and a flexible hose coupled to the first ferrule with the clamp of the first ferrule and coupled to the second ferrule with the clamp of the second ferrule, the flexible hose defining an outer channel between the rigid pipe and the flexible hose, the conduit of each of the first ferrule and the second ferrule is in fluid communication with the outer channel, the conduit of each one of the first ferrule and the second ferrule extends through apertures defined by both the flexible hose and the clamp;

wherein each of the first ferrule and the second ferrule include a second flange that is opposite to and spaced apart from the first flange, a portion of the outer channel is between the first flange and the second flange.

10. The double pipe internal heat exchanger of claim 9, wherein the flexible hose completely surrounds a portion of the rigid pipe circumferentially.

11. The double pipe internal heat exchanger of claim 9, wherein the clamp of the first ferrule extends in a direction from a base of the first ferrule, and the clamp of the second ferrule extends in a direction from a base of the second ferrule.

12. The double pipe internal heat exchanger of claim 9, wherein the first flange and the second flange extend from a common base.

13. The double pipe internal heat exchanger of claim 9, wherein the flexible hose is impermeable to liquid.

14. The double pipe internal heat exchanger of claim 9, wherein:

the rigid pipe and the outer channel are configured to permit passage of one of gas or liquid refrigerants through the inner channel and the other of gas or liquid refrigerants through the outer channel to permit exchange of heat between the gas and the liquid refrigerants; and the clamp is crimped onto the flexible hose.

15. A double pipe internal heat exchanger comprising:

a rigid pipe defining an inner channel;

a first ferrule mounted to the rigid pipe at a first end of the rigid pipe, the first ferrule including a first conduit;

a second ferrule mounted to the rigid pipe at a second end of the rigid pipe, the second ferrule including a second conduit; and a flexible hose coupled to both the first ferrule and the second ferrule, the flexible hose extending between the first ferrule and the second ferrule and surrounding a portion of the rigid pipe circumferentially to define an outer channel between the flexible hose and the rigid pipe, each of the first conduit and the second conduit are in fluid communication with the outer channel;

wherein:

each of the first ferrule and the second ferrule include a clamp that is structurally integrated therewith, surrounds, captures, and is crimped onto the flexible hose to secure the flexible hose to each of the first ferrule and the second ferrule;

the clamp of each of the first ferrule and the second ferrule circumferentially surrounds a portion of first and second flanges of each of the first and second ferrules, the first flange mounted directly to the rigid pipe and the second flange spaced apart from the first flange to define a portion of the outer channel therebetween;

the first conduit extends through first apertures defined by each of the clamp of the first ferrule and the flexible hose;

the second conduit extends through second apertures defined by each of the clamp of the second ferrule and the flexible hose;

the clamp of the first ferrule extends from a second flange of the first ferrule, the second flange of the first ferrule is opposite to the first flange of the first ferrule, the clamp of the first ferrule completely surrounds a first end of the flexible hose and secures the first end of the flexible hose in a first receptacle defined between the clamp of the first ferrule and the second flange of the first ferrule;

the clamp of the second ferrule extends from a second flange of the second ferrule, the second flange of the second ferrule is opposite to the first flange of the second ferrule, the clamp of the second ferrule completely surrounds a second end of the flexible hose and secures the second end of the flexible hose in a second receptacle defined between the clamp of the second ferrule and the second flange of the second ferrule;

the outer channel is partially defined between the first flange and the second flange of each of the first ferrule and the second ferrule;

the first flange and the second flange of the first ferrule each extend from a base;

the first flange and the second flange of the second ferrule each extend from a base;

the flexible hose includes at least one of a leak resistant rubber, a leak resistant polymer, or a leak resistant nylon;

the flexible hose is configured to dampen vibrations;

the first conduit extends through the clamp of the first ferrule and the flexible hose; and the second conduit extends through the clamp of the second ferrule and the flexible hose.

16. The double pipe internal heat exchanger of claim 15, wherein the clamp of the first ferrule extends generally in a direction perpendicular from a base of the first ferrule, and the clamp of the second ferrule extends generally in a direction perpendicular from a base of the second ferrule.

* * * * *